US005640996A

United States Patent [19]

Schlecht et al.

[11] Patent Number: 5,640,996

[45] Date of Patent: Jun. 24, 1997

[54] LARGE MANIPULATOR, ESPECIALLY FOR SELF-PROPELLED CONCRETE PUMPS

[75] Inventors: Karl Schlecht; Hartmut Benckert, both of Filderstadt, Germany

[73] Assignee: Putzmeister-Werk Maschinenfabrik GmbH, Aichtal, Germany

[21] Appl. No.: 513,790

[22] PCT Filed: Dec. 4, 1993

[86] PCT No.: PCT/EP93/03416

§ 371 Date: Aug. 25, 1995

§ 102(e) Date: Aug. 25, 1995

[87] PCT Pub. No.: WO94/19563

PCT Pub. Date: Sep. 1, 1994

[30] Foreign Application Priority Data

Feb. 27, 1993 [DE] Germany ..... 43 06 127.3

[51] Int. Cl.[6] ..... B65Q 53/00; G65G 53/32; G65G 53/66

[52] U.S. Cl. ..... 137/615; 91/361

[58] Field of Search ..... 137/615; 91/361

[56] References Cited

U.S. PATENT DOCUMENTS

| | | | |
|---|---|---|---|
| 3,685,543 | 8/1972 | Schwing et al. | 137/615 |
| 3,970,830 | 7/1976 | White et al. | 91/361 |
| 4,205,308 | 5/1980 | Haley et al. | 137/615 |
| 4,276,975 | 7/1981 | Jenkins | 193/10 |
| 4,643,074 | 2/1987 | Gunda et al. | 91/361 |
| 4,896,582 | 1/1990 | Tordenmalm et al. | 91/361 |
| 5,189,940 | 3/1993 | Hosseini et al. | 91/361 |
| 5,333,533 | 8/1994 | Hosseini | 91/361 |

FOREIGN PATENT DOCUMENTS

| | | |
|---|---|---|
| 3130727 | 2/1983 | Germany . |
| 3339495 | 7/1984 | Germany . |
| 3445130 | 2/1986 | Germany . |
| 3446290 | 6/1986 | Germany . |
| 3830315 | 3/1990 | Germany . |
| 3931255 | 5/1990 | Germany . |
| 3911677 | 10/1990 | Germany . |
| 2228065 | 8/1990 | United Kingdom . |

OTHER PUBLICATIONS

Entwicklung der Antriebshydraulik für mobile Betonverteilermaste by H. Benckert & H. Renz; O +P Olhydraulik und Pneumatik, 36, 1992, Nr. 4; pp. 242–244, 247, 248, 251.

Hochflexibles Arbeitsgerät von Putzmeister; ATZ Automobiltechnische Zeitschrift 92, 1990, 1; p. 36.

*Primary Examiner*—A. Michael Chambers

*Attorney, Agent, or Firm*—Flynn, Thiel, Boutell & Tanis, P.C.

[57] ABSTRACT

The invention relates to a large manipulator, especially for truck mounted concrete pumps. A chassis bears a mast base rotatable about a vertical pivot and an articulated mast consisting of at least three arms. The arms can be pivoted to a limited extent about horizontal, mutually parallel axes in pairs in relation to the adjacent base or arm by means of a drive system. The articulated mast is actuated via a remote control device with control levers. In order to ensure a clear allocation of the movements of the control lever and the articulated mast, the invention proposes that the remote control device have a computer-supported co-ordinate transmitter controllable via the control lever for the drive systems via which, in one path of adjustment of the control lever, the drive systems for the pivots can be actuated independently of the drive system for the pivot of the mast base with the accomplishment of an extending or retracting movement of the articulated mast for a predetermined height of the tip of the mast. In the other path of adjustment of the control lever perpendicular to the first path, a rotary movement of the articulated mast about the pivot is triggered via the co-ordinate transmitter independently of the movement in the axes with a predetermined height of the tip of the articulated mast.

21 Claims, 2 Drawing Sheets

LARGE MANIPULATOR, ESPECIALLY FOR SELF-PROPELLED CONCRETE PUMPS

FIELD OF THE INVENTION

The invention relates to a large manipulator, especially for truck mounted concrete pumps, comprising a mast arranged on a frame, preferably on a chassis, so as to be drivable about an essentially vertical axis by means of a driving system, comprising an articulated mast preferably designed as a concrete-distribution mast and composed of at least three mast arms, which mast arms are limited pivotally about each of the horizontal axes, which are parallel to one another, relative to the respective adjacent mast base or mast arm each by means of one further driving system, and comprising a remote-control device having at least one control lever for controlling the driving systems, whereby the control lever can be adjusted forwardly and backwardly along two main-position paths, which are perpendicular to one another, and whereby the remote-control device has a computer-assisted coordinate transmitter for the driving systems, which coordinate transmitter can be controlled through the control lever.

BACKGROUND OF THE INVENTION

Truck mounted concrete pumps of this type are mobile tools, which can be utilized with a full 360°-swing range of the mast base with the articulated mast at an extended horizontal position. The operator is responsible for controlling the self-propelled concrete pump and for the positioning of the concrete end hose at the last arm of the articulated mast. He must thereby control more than two rotatoric degrees of freedom of the articulated mast through the associated driving systems during the movement of the articulated mast in the nonstructured three-dimensional work space while paying attention to the conditions at the edge of the building site. With the use of proportional radio telecontrols the operator's work was made easier in such a manner that the operator is no longer linked with a cable spacially to the self-propelled concrete pump. However, there exists furthermore the risk that uncontrolled movements at the end hose can occur during a single-axis operation, thus endangering the building site personnel. To make handling of the large manipulator easier, instead of the individual control of the rotatoric degrees of freedom of the articulated mast it has already been suggested to move the end hose through suitable computer-assistance in a Cartesian x-, y-, z-coordinate system with the help of control levers, whereby a frame-fixed or building-site-fixed coordinate system can be selectively chosen. ("Computer Controlled Concrete Distribution", Dr. -Ing. Hartmut Benckert, Putzmeister-Werk, Pages 111–119, 8th Int. Symposium on Automation and Robotics, IPA (FHG) Stuttgart 1991). However, this type of operation has proven to be rather complicated in many cases since the operation of the control levers needed for this cannot be easily brought into harmony with the optically recognizable sequences of movement of the articulated mast.

Starting out from this the basic purpose of the invention is to improve the conventional large manipulator of the above-disclosed type in such a manner that it will be possible for the operator to control any points in the area within the reach of the articulated mast by simple manipulations of the operating elements.

SUMMARY OF THE INVENTION

The invention starts out from the recognition that by a common control of the redundant articulated axes of the articulated mast independent of the axis of rotation of the mast base with one single adjusting operation of the control lever, an extending or collapsing movement of the articulated mast, which movement is clear to the operator, can be carried out at a pregiven height of the tip of the articulated mast. In order to achieve this, it is suggested according to the invention that the driving systems of the axes can be operated through the coordinate transmitter in the one main-position path of the control lever independent of the driving system of the pivot of the mast base while carrying out an extending or collapsing movement of the articulated mast at a pregiven height of the tip of the articulated mast, and that the driving systems of the redundant axes of the articulated mast can each be operated according to a selectively predefinable path-swivel characteristic.

According to a preferred development of the invention the driving system of the pivot of the mast base can be operated through the coordinate transmitter in the other main position path of the control lever, which direction is perpendicular to the first one, or in the one main-position path of a further control lever independent from the driving systems of the axes while carrying out a rotary movement of the articulated mast at a pregiven height of the tip of the articulated mast. It is furthermore advantageous when the driving systems of the axes can in addition be operated through the coordinate transmitter in the other main-position path of the control lever, which path is perpendicular with respect to the first one, or in the one main-position path independent from the driving system of the pivot of the mast base while carrying out a lifting or lowering movement of the tip of the mast and while maintaining its radial distance from the pivot.

Since the mast arms which depend on their alignment with respect to the gravitation axis on the one hand and on the load engaging said arms (for example concrete in the conveyor pipe) on the other hand, are subjected to more or less bending and torsion movements, which adulterate the position of the tip of the mast at given swivelling positions in the individual joints, it is suggested according to a preferred development of the invention that the path-swivel characteristic can be modified in the coordinate transmitter according to load-dependent bending and/or torsion moments engaging the individual mast arms. The same is true when obstacles must be overcome in order to avoid collisions in the area of movement of the articulated mast. It is advantageous for this purpose that the path-swivel characteristic of the axes can be modified in the coordinate transmitter according to collision zones spacially defining the mast-arm movement, in particular by specifying a highest and/or lowest articulated point. Further safety is achieved in this regard when the path-swivel characteristic of the axes can be modified in the coordinate transmitter according to measuring signals emitted by a distance sensor preferably arranged on the last mast arm.

To broaden the possibilities for use of the remote-control device it is advantageous that the control levers can be switched through the coordinate transmitter selectively to frame-fixed or building-site-fixed Cartesian coordinates or to the individual joint coordinates.

BRIEF DESCRIPTION OF THE DRAWINGS

The invention will be discussed in greater detail hereinafter in connection with one exemplary embodiment schematically illustrated in the drawings, in which.

DETAILED DESCRIPTION

Figure 1:
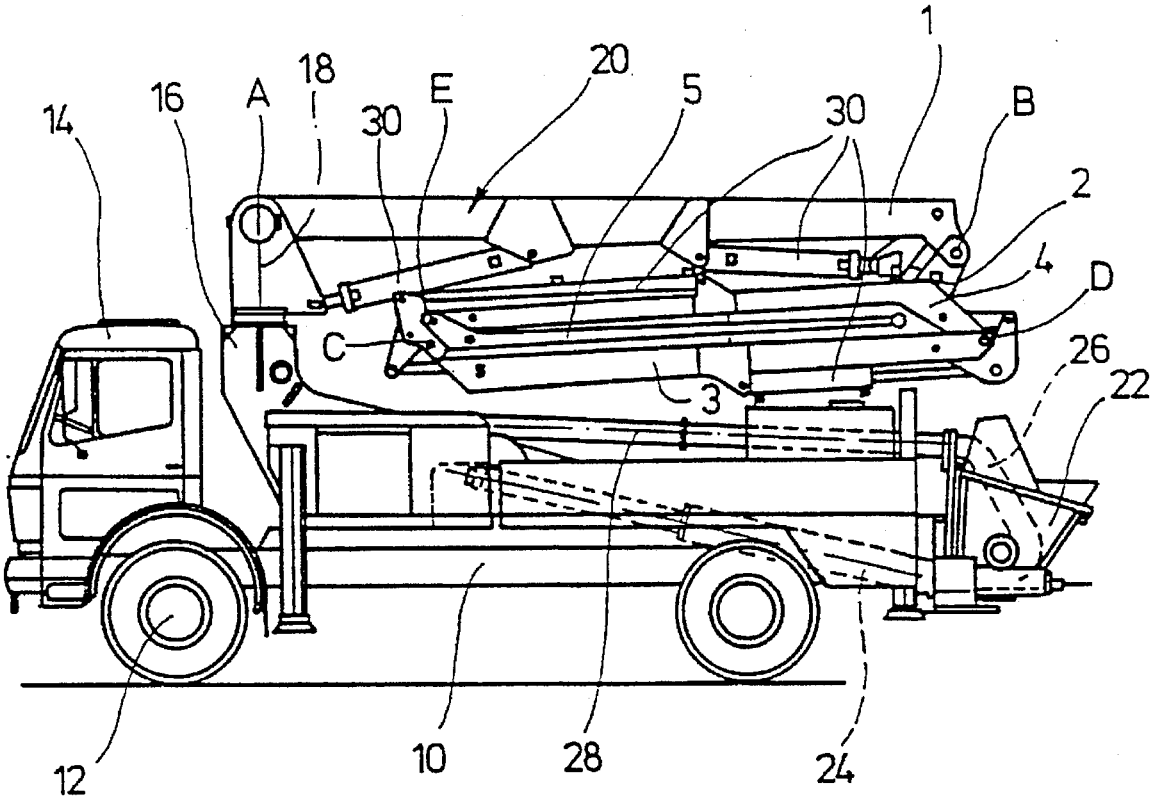
FIG. 1 is a side view of a truck mounted concrete pump with a five-arm articulated mast in a collapsed state.

The truck mounted concrete pump illustrated in the drawings has a chassis 10, a mast base 16 arranged in the vicinity of the front axle 12 and the cab 14 of the chassis 10, an articulated mast 20 rotatable 360° on the mast base 16 about a vertical pivot 18 by means of a hydraulic rotating system, not illustrated, a hydraulically driven concrete pump 24 loadable with concrete through a material-feeding container 22, and a conveyor pipeline 28 connected to the concrete pump 24 through a pipe switch 26. The articulated mast 20 has five arms 1, 2, 3, 4 and 5, which are pivotally connected with one another at the joint A to the mast base 16 and at the joints B, C, D and E each about horizontal axes. For the collapsing and extending of the mast arms 1 to 5 about the joints A to E, driving systems 30 constructed as double-acting hydraulic cylinder 30 are provided, which are hinged with their free cylinder-side and rod-side ends to the booms or folding bars of the mast arms 1 to 5 of the mast base 16.

Figure 2A:
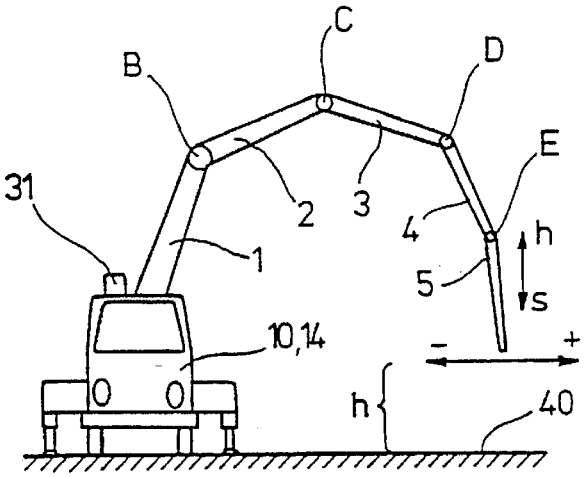
FIG. 2*a* and *b* are a side view and a top view of a self-propelled concrete pump with an extended articulated mast.
Figure 2B:
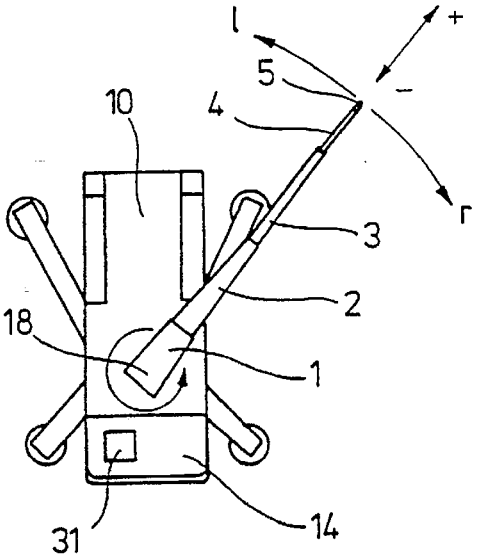

The mast arms are illustrated in FIG. 1 in the travelling position folded against one another in an alignment, in which they are essentially parallel to one another, whereas they are extended in the illustration according to FIGS. 2*a* and *b*.

A remote-control device is provided for operating the driving systems of the articulated mast, which remote-control device includes a radio-telecontrol device 80 and a vehicle-fixed control device 31 communicating with the radio-telecontrol device 80 by means of transceivers 36, 36' through a bidirectional radio path 38. The radio-telecontrol device 80 has several operating members 34, 34', 34" emitting control signals, which are designed as control levers, and which can each be adjusted in two main-position paths perpendicular to one another forwardly and backwardly. The control signals are transmitted through the bidirectional radio path to the vehicle-fixed transceiver 36' and are converted in a data-processing step 40 and a computer supported coordinate transmitter 42 into coordinate signals for the driving systems 30 of the six axes 18, A, B, C, D, E. In addition the magnitude of the deflection of the control levers 34, 34', 34" can be converted through suitable sensors or electronics into speed-determining signals.

Figure 3A:
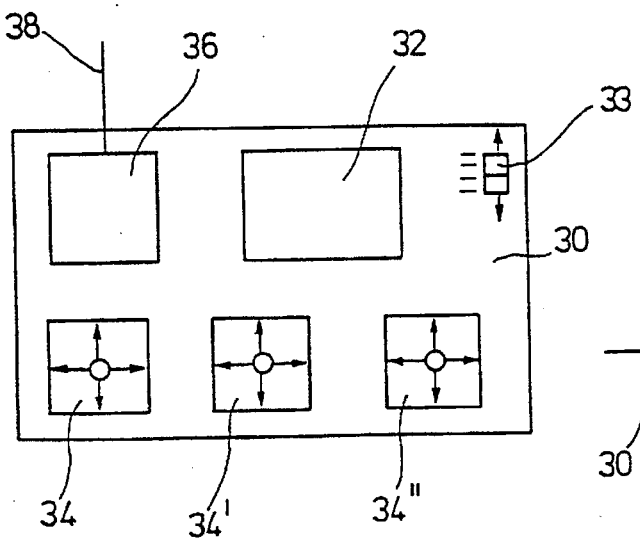
FIG. 3*a* and *b* are a schematic illustration of each one section of the vehicle-remote and vehicle-fixed part of a remote control device.
Figure 3B:
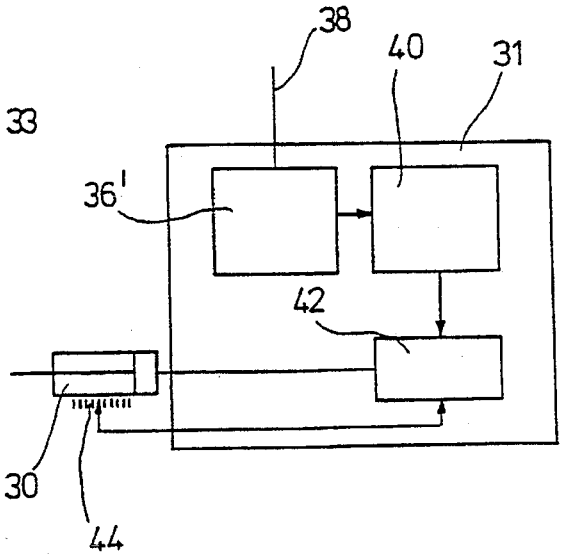

The driving systems 30 of all axes A to E are in the exemplary embodiment illustrated in FIGS. 2*a* and *b* in connection with FIGS. 3*a* and *b* controlled individually or in their entirety through the control lever 34 in the one main-position path (+, −) with the support of a vehicle-fixed calculator such that the articulated mast 20 carries out an extending movement in the plus direction and a collapsing movement in the minus direction at a constant rotary position of the mast base 16 and at a constant height h of the articulated mast above the ground 140. Each axis A to E is software-like controlled within the coordinate transmitter 42 in such a manner that the articulated joints move harmoniously to one another in dependency of path and time. If the driving systems associated with the axes are designed as hydraulic cylinders 30 with length-measuring systems 44 stored in the cylinders, it is possible for this purpose to recalculate the measured stroke movement of the cylinder with the help of a pregiven path-swivel characteristic into the associated rotary movement of the joint. Thus the control of the redundant degrees of freedom of the articulated joints is done according to a preprogrammed strategy, during which collision zones, like obstacles, ceilings, built-ins and the like, also can be fed in through the operation software and can be taken into consideration during the sequence of movement. To increase the exactness, one can fall back on correction data stored in data files (for example for the compensation of a load-dependent deformation).

The adjustment of the rotary position of the articulated mast 20 in the mast base 16 about the pivot 18 occurs in the illustrated exemplary embodiment by operating the control lever 34 in a horizontal main-position direction (r, l), whereby in the direction r a right rotation and in the direction l a left rotation about the pivot 18 is triggered. The lifting-lowering movement (h, s) of the end tube arranged at the tip of the mast, for example while maintaining the radial deflection of the articulated mast 20, can be triggered through a further operating lever 34' while controlling the driving systems 30 of the axes A to E. During an operation of the control lever in an intermediate direction deviating from the main-position directions, which are perpendicular to one another, both control types will respond each like a component fractionization.

It is possible with these measures to travel with the tip of the mast through the entire space within the reach of the articulated mast with the necessary collision limitations with only three main-position directions using two control levers (34, 34'), whereby the movements of the control levers can be converted in a manner understandable to the operator into the three mentioned components of movement of the articulated mast 20. The operator can read on the display 32 the actual coordinate values of the tip of the mast in a coordinate system selected through the selector switch 33.

In conclusion the following is stated: The invention relates to a large manipulator, especially for self-propelled concrete pumps. A mast base drivable about a vertical pivot 18 and an articulated mast composed of at least three mast arms 1 to 5 are arranged on a chassis. The mast arms 1 to 5 of the articulated mast can be limited pivotally about horizontal axes A to E, which are parallel to one another, in pairs relative to the respective adjacent mast base 16 or mast arm 1 to 5 by means of each having one driving system 30. The articulated mast is operated through a remote-control device 30 by control levers 34, 34', 34". In order to guarantee a clear association between the movements of the control lever 34 and of the articulated mast, it is suggested according to the invention that the remote-control device has a computer assisted coordinate transmitter 42 for the driving systems 30, which transmitter can be controlled through the control lever 34, and through which in the one main position direction (+, −) of the control lever 34, the driving systems 30 of the axes A to E can be operated independently from the driving system of the pivot 18 of the mast base 16 carrying out an extending or collapsing movement of the articulated mast 20 at a pregiven height h of the tip of the mast. In the other main-position direction (l, r) of the control lever 34, which direction is perpendicular to the first one, a rotary movement of the articulated mast 20 about the pivot 18 is triggered through the coordinate transmitter 42, in particular independent from the movement in the axes A to E at a pregiven height h of the tip of the articulated mast.

We claim:

1. A large manipulator for truck mounted concrete pumps, comprising:

a mast base arranged on a vehicle frame drivable about a generally vertical pivot by means of a first driving system;

an articulated mast positioned on said mast base, said articulated mast being composed of at least three mast arms joined by articulated pivots, and a second driving system for pivoting selected ones of said mast arms limitedly about horizontal axes of said articulated pivots relative to one of the respective adjacent said mast base and said mast arms, said horizontal axes being parallel to one another, a last mast arm of said at least three mast arms distal said mast base has a tip at a distal end thereof orientable at a select height; and a remote-control device having at least one control lever for controlling said first and second driving systems, said at least one control lever being movable in two directions along two separate main-position paths which are perpendicular to one another, said remote-control device further having a computer-assisted coordinate transmitter for controlling said first and second driving systems, said coordinate transmitter being controlled by said at least one control lever and includes a means for storing a plurality of predefinable path-swivel characteristics of each said articulated pivot about said horizontal axes and said at least three mast arms, wherein said computer-assisted coordinate transmitter includes means for effecting a radial movement of said articulated mast with said tip at said select height in response to an actuating of said second driving system caused by said at least one control lever travelling along one of said main-position paths independent from an operation of said first driving system.

2. The large manipulator according to claim 1, wherein said coordinate transmitter includes means for effecting an operation of said first driving system so as to pivot said mast base in response to said at least one control lever travelling along the other main-position path independent of said means for effecting said radial movement.

3. The large manipulator according to claim 1, wherein said coordinate includes means for effecting a vertical movement of said tip via an actuation of said second driving system in response to said at least one control lever travelling along the other main-position path, independent of said first driving system.

4. The large manipulator according to claim 1, wherein said path-swivel characteristics of said horizontal axes are modifiable in said coordinate transmitter according to at least one of load-dependent bending and torsion moments of individual ones of said at least three mast arms.

5. The large manipulator according to claim 1, wherein said path-swivel characteristics of said horizontal axes are modifiable in said coordinate transmitter according to collision zones spacially limiting movement of said at least three mast arms by specifying at least one of a highest and a lowest articulated point.

6. The large manipulator according to claim 1, further comprising a distance sensor for emitting measuring signals arranged on said last mast arm, and wherein said path-swivel characteristics of said horizontal axes are modifiable in said coordinate transmitter according to the measuring signals emitted by said distance sensor.

7. The large manipulator according to claim 1, wherein a movement of said at least one control lever is converted in said coordinate transmitter to one of a frame-fixed Cartesian coordinates, or building-site-fixed Cartesian coordinates and individual joint coordinates.

8. The large manipulator according to claim 1, wherein said remote-control device operates in radio frequencies and has a first transceiver unit and a second transceiver unit electromagnetically connected to each other by a radio path, said first transceiver being operably connected to said at least one control lever, said second transceiver being electrically connected to said computer-assisted coordinate transmitter and being fixed to said vehicle frame.

9. The large manipulator according to claim 1, wherein in addition to said at least one control lever there is provided a second control lever, said second control lever is movable in two directions along at least one secondary path, and wherein said coordinate transmitter has means for effecting an operation of said first driving system so as to pivot said mast base in response to said second control lever travelling along said at least one secondary path independent of said means for effecting said radial movement.

10. The large manipulator according to claim 1, wherein in addition to said at least one control lever there is provided a second control lever, said second control lever is movable in two directions along at least one secondary path, and wherein said coordinate transmitter has means for effecting a vertical movement of said tip caused by said second driving system in response to said second control lever travelling along said at least one secondary path independent of said first driving system.

11. A truck mounted concrete pump comprising:

a vehicle frame; a mast base pivotally mounted on said vehicle frame; a first drive means for rotating said mast base relative to said vehicle frame about a vertical pivot in one of a first direction of rotation and a second direction of rotation; an articulated mast positioned on said mast base having at least three mast arms, said at least three mast arms being pivotal about horizontal axes therebetween, a last mast arm of said at least three mast arms distal said mast base has a tip at a distal end of said last mast arm orientable at a select height; a second drive means for pivoting selected ones of said at least three mast arms about said horizontal axis; a computer-assisted coordinate transmitter having a means for controlling said first and second drive means, a storage means for storing path-swivel characteristic data of said articulated mast, and a first transceiver; and a radio remote-control device having a first control lever and a second transceiver, said first and second transceivers being electromagnetically connected along a radio path, said first control lever including means for facilitating movement of said first control lever in four directions and a means for emitting a first control signal in response to a movement of said first control lever in a first direction of said four directions to said second transceiver, said second transceiver including means for transmitting said first control signal to said first transceiver along said radio path, said first transceiver including means for transmitting said first control signal to said computer-assisted coordinate transmitter, said computer-assisted coordinate transmitter including means for converting said first control signal into a coordinate signal for said means for controlling said second driving means to effect a radial extension of said articulated mast with said tip at said select height.

12. The truck mounted concrete pump according to claim 11, wherein said first control lever includes a means for emitting a second control signal in response to a movement of said first control lever in a second direction of said four directions to said second transceiver, said second direction being opposite said first direction, wherein said second transceiver includes means for transmitting said second control signal to said first transceiver along said radio path, wherein said first transceiver includes means for transmitting said second control signal to said computer-assisted coordinate transmitter, and wherein said computer-assisted coordinate transmitter includes means for converting said second control signal into a coordinate signal for said means for controlling said second driving means to effect a radial contraction of said articulated mast with said tip at said select height.

13. The truck mounted concrete pump according to claim 12, wherein said first control lever includes a means for emitting a third control signal in response to a movement of said first control lever in a third direction of said four directions to said second transceiver, said third direction being perpendicular to said first and second directions, wherein said second transceiver includes means for transmitting said third control signal to said first transceiver along said radio path, wherein said first transceiver includes means for transmitting said third control signal to said computer-assisted coordinate transmitter, and wherein said computer-assisted coordinate transmitter includes means for converting said third control signal into a coordinate signal for said means for controlling said first driving means to effect a rotation of said mast base in said first direction of rotation.

14. The truck mounted concrete pump according to claim 13, wherein said first control lever includes means for emitting a fourth control signal in response to a movement of said first control lever in a fourth direction of said four directions to said second transceiver, said fourth direction being opposite said third direction and perpendicular to said first and second directions, wherein said second transceiver includes means for transmitting said fourth control signal to said first transceiver along said radio path, wherein said first transceiver includes means for transmitting said fourth control signal to said computer-assisted coordinate transmitter, and wherein said computer-assigned coordinate transmitter includes means for converting said fourth control signal into a coordinate signal for said means for controlling said first driving means to effect a rotation of said mast base in said second direction of rotation.

15. The truck mounted concrete pump according to claim 14, wherein said means for converting said first control signal, said means for converting said second control signal, said means for converting said third control, and said means for converting said fourth control signal each include means for correcting a respective said control signal with said stored path-swivel characteristic data of said articulated mast in said computer-assisted coordinate transmitter.

16. The truck mounted concrete pump according to claim 14, further comprising a first, second, third, and fourth intermediate directions of movement of said first control lever, said first intermediate direction being intermediate said first and third directions, said second intermediate direction being intermediate said third and second directions, said third intermediate direction being intermediate said second and fourth directions, said fourth intermediate direction being intermediate said fourth and first directions, and wherein said first control lever includes means for simultaneously emitting said first and said third control signals in response to a movement of said first control lever in said first intermediate direction, a means for simultaneously emitting said third and second control signals in response to a movement of said first control lever in said second intermediate direction, a means for simultaneously emitting said second and fourth control signals in response to a movement of said first control lever in said third intermediate direction, and a means for simultaneously emitting said fourth and first control signals in response to a movement of said first control lever in said fourth intermediate direction.

17. The truck mounted concrete pump according to claim 12, wherein said first control lever includes means for emitting a raising control signal in response to a movement of said first control lever in a third direction of said four directions to said second transceiver, said third direction being perpendicular to said first and second directions, wherein said second transceiver includes means for transmitting said raising control signal to said first transceiver along said radio path, wherein said first transceiver includes means for transmitting said raising control signal to said computer-assisted coordinate transmitter, and wherein said computer-assisted coordinate transmitter includes means for converting said raising control signal into a coordinate control signal for said means for controlling said second driving means to effect a vertical raising of said tip.

18. The truck mounted concrete pump according to claim 17, wherein said first control lever includes means for emitting a lowering control signal in response to a movement of said first control lever in a fourth direction of said four directions to said second transceiver, said fourth direction being opposite said third direction and perpendicular to said first and second directions, wherein said second transceiver includes means for transmitting said lowering control signal to said first transceiver along said radio path, wherein said first transceiver includes means for transmitting said lowering control signal to said computer-assisted coordinate transmitter, and wherein said computer-assisted coordinate transmitter includes means for converting said lowering control signal into a coordinate control signal for said means for controlling said second driving means to effect a vertical lowering of said tip.

19. The truck mounted concrete pump according to claim 11, wherein said radio remote-control device has a second control lever, said second control lever has means for facilitating movement of said second control level in at least two directions, a first direction of said at least two directions being opposite a second direction of said at least two directions, said second control lever including means for emitting a raising control signal in response to a movement of said second control lever in said first direction of said at least two directions to said second transceiver, wherein said second transceiver includes means for transmitting said raising control signal to said first transceiver along said radio path, wherein said first transceiver includes means for transmitting said raising control signal to said computer-assisted coordinate transmitter, and wherein said computer-assisted coordinate transmitter includes means for converting said raising control signal into a coordinate control signal for said second driving means to effect a vertical raising of said tip.

20. The truck mounted concrete pump according to claim 19 wherein said second control lever includes means for emitting a lowering control signal in response to a movement of said second control lever in said second direction of said at least two directions to said second transceiver, wherein said second transceiver includes means for transmitting said lowering control signal to said first transceiver along said radio path, wherein said first transceiver includes means for transmitting said lowering control signal to said computer-assisted coordinate transmitter, and wherein said computer-assisted coordinate transmitter includes means for converting said lowering control signal into a coordinate control signal for said means for controlling said second driving means to effect a vertical lowering of said tip.

21. The truck mounted concrete pump according to claim 11, further comprising a distance sensor on said last mast arm for emitting a distance signal, said distance sensor including means for transmitting said distance signal to said computer-assisted coordinate transmitter, and said computer-assisted coordinate transmitter including means for adjusting said control signal in response to said distance signal.

* * * * *